US011459822B2

(12) United States Patent
McNeill

(10) Patent No.: US 11,459,822 B2
(45) Date of Patent: Oct. 4, 2022

(54) TILT-CONTROL ASSEMBLY FOR USE WITH AN OPERATING MECHANISM IN AN ARCHITECTURAL-STRUCTURE COVERING

(71) Applicant: Hunter Douglas Inc., Pearl River, NY (US)

(72) Inventor: David McNeill, Denver, CO (US)

(73) Assignee: Hunter Douglas Inc., Pearl River, NY (US)

( * ) Notice: Subject to any disclaimer, the term of this patent is extended or adjusted under 35 U.S.C. 154(b) by 340 days.

(21) Appl. No.: 16/742,389

(22) Filed: Jan. 14, 2020

(65) Prior Publication Data

US 2020/0256122 A1 Aug. 13, 2020

Related U.S. Application Data

(60) Provisional application No. 62/804,496, filed on Feb. 12, 2019.

(51) Int. Cl.
*E06B 9/36* (2006.01)

(52) U.S. Cl.
CPC ..... *E06B 9/361* (2013.01); *E06B 9/368* (2013.01)

(58) Field of Classification Search
CPC . E06B 9/361; E06B 9/364; E06B 9/90; E06B 9/307; E06B 9/368; E06B 9/262; F16H 25/2204; F16H 15/503; F16H 25/20
See application file for complete search history.

(56) References Cited

U.S. PATENT DOCUMENTS 1,942,320 A * 1/1934 Young ..... E05D 13/123 160/295
2,314,015 A * 3/1943 Parsons ..... E05D 13/1261 160/191
2,493,234 A * 1/1950 Johnw ..... E06B 9/305 160/167 R
2,779,206 A * 1/1957 Doerfner ..... F16H 25/2204 74/89.42

(Continued)

FOREIGN PATENT DOCUMENTS

CN 103016584 A 4/2013
DE 922095 * 1/1955 ..... F16H 25/24

(Continued)

*Primary Examiner* — Daniel P Cahn
*Assistant Examiner* — Abe Massad
(74) *Attorney, Agent, or Firm* — KDB Firm PLLC

(57) ABSTRACT

A tilt-control assembly for use with an operating mechanism of an architectural-structure covering is disclosed. The tilt-control assembly includes a limiter having an external screw thread and a ball operatively associated with the screw threads so that rotation of the limiter moves the ball relative to the limiter. The screw threads may include variable pitch threads. For example, the screw thread may include a middle thread pitch in a middle portion of the screw thread and an end thread pitch adjacent to the ends of the screw thread, the middle thread pitch being smaller than the end thread pitch. In addition, the limiter and/or screw threads may include a variable diameter. The ball may be positioned within a groove including a contoured surface that substantially corresponds to the variable diameter. The ends of the screw thread may include substantially spherically shaped end portions for receiving the ball therein.

19 Claims, 7 Drawing Sheets

(56) References Cited

U.S. PATENT DOCUMENTS

| | | | | | |
|---|---|---|---|---|---|
| 3,730,018 | A * | 5/1973 | Bishop | F16H 1/16 | 74/498 |
| 3,789,905 | A * | 2/1974 | Saito | E06B 9/361 | 160/168.1 V |
| 3,878,877 | A * | 4/1975 | Bruneau | E06B 9/361 | 160/172 R |
| 4,047,554 | A | 9/1977 | Bullat | | |
| 4,138,902 | A * | 2/1979 | Brusasco | F16H 25/2427 | 74/424.77 |
| 4,221,137 | A * | 9/1980 | Futaba | F16H 25/2209 | 74/424.82 |
| 4,224,973 | A | 9/1980 | Hugin | | |
| 4,295,384 | A | 10/1981 | Brandt et al. | | |
| 4,557,159 | A * | 12/1985 | Gross | E06B 9/361 | 160/168.1 V |
| 4,590,816 | A | 5/1986 | Weyer | | |
| 4,724,883 | A | 2/1988 | Liebowitz | | |
| 4,739,671 | A | 4/1988 | Nelson | | |
| 5,266,068 | A * | 11/1993 | Benthin | E06B 9/36 | 160/176.1 V |
| 5,603,369 | A | 2/1997 | Colson et al. | | |
| 5,954,108 | A * | 9/1999 | Oda | E06B 9/368 | 160/168.1 P |
| 6,330,903 | B1 * | 12/2001 | Weinreich | E05D 13/1207 | 160/295 |
| 7,946,403 | B2 | 5/2011 | Burke et al. | | |
| 8,074,777 | B2 | 12/2011 | Birdi et al. | | |
| 8,549,947 | B2 | 10/2013 | Iwase et al. | | |
| 9,095,908 | B2 | 8/2015 | Mullet et al. | | |
| 9,182,022 | B2 | 11/2015 | Wingett et al. | | |
| 9,353,570 | B2 | 5/2016 | Smith et al. | | |
| 9,410,366 | B2 | 8/2016 | Kwak | | |
| 9,540,873 | B1 | 1/2017 | Townsley | | |
| 9,725,949 | B2 | 8/2017 | Townsley | | |
| 9,963,935 | B2 | 5/2018 | Faller | | |
| 10,030,439 | B2 | 7/2018 | Smith et al. | | |
| 2006/0156845 | A1 | 7/2006 | Tong | | |
| 2016/0083998 | A1 | 3/2016 | Grutzner | | |
| 2016/0312531 | A1 | 10/2016 | Kwak | | |
| 2017/0198521 | A1 | 7/2017 | Zhang | | |
| 2017/0241198 | A1 | 8/2017 | McNeill et al. | | |
| 2017/0335624 | A1 | 11/2017 | Townsley | | |
| 2018/0298684 | A1 * | 10/2018 | Siebenaller | E06B 9/368 | |
| 2019/0106925 | A1 * | 4/2019 | McCorkell | F16H 25/24 | |
| 2021/0310548 | A1 * | 10/2021 | Niermann | F16H 25/20 | |

FOREIGN PATENT DOCUMENTS

| | | | | |
|---|---|---|---|---|
| DE | 102008000346 | A1 * | 8/2009 | B60J 7/0573 |
| EP | 357935 | A * | 3/1990 | B23Q 5/40 |
| WO | WO-2009149708 | A1 * | 12/2009 | E06B 9/307 |
| WO | 2017067552 | A2 | 4/2017 | |

* cited by examiner

TILT-CONTROL ASSEMBLY FOR USE WITH AN OPERATING MECHANISM IN AN ARCHITECTURAL-STRUCTURE COVERING

CROSS-REFERENCE TO RELATED APPLICATIONS

This is a non-provisional of, and claims the benefit of the filing date of, U.S. provisional patent application No. 62/804,496, filed Feb. 12, 2019, entitled "Tilt-Control Assembly for Use with an Operating Mechanism in an Architectural-Structure Covering," which application is incorporated by reference herein in its entirety.

FIELD OF THE DISCLOSURE

The present disclosure relates generally to the field of architectural-structure coverings, and relates more particularly to an improved tilt-control assembly for use in an architectural-structure covering.

BACKGROUND

Architectural-structure coverings may selectively cover an architectural structure such as, for example, a window, a doorway, a skylight, a hallway, a portion of a wall, etc. Architectural-structure coverings may come in a variety of configurations. One common type of architectural-structure covering is a horizontally-extending architectural-structure covering.

A horizontally-extending architectural-structure covering may include a head rail assembly and a covering. In use, the covering or components thereof are suspended from the head rail assembly. The head rail assembly is operatively associated with a control system. The architectural-structure covering may also include an operating mechanism including an operating element such as, for example, a tilt wand and pull cord system to move the covering between an extended position and a retracted position. As will be readily appreciated by one of ordinary skill in the art, in the extended position, the covering may extend widthwise across the architectural structure (e.g., window), while in the retracted position, the covering may be retracted to reveal the architectural structure. That is, in use, the operating mechanism is used to extend and to retract (e.g., move) the covering in a horizontal direction along a length of the head rail assembly. Thus, the operating mechanism may be used to control the amount of extension or retraction of the covering across the architectural structure.

In addition, the operating element may also operatively control the angle of the covering or components thereof to move the covering or components thereof between an open configuration and a closed configuration. As will be readily appreciated by one of ordinary skill in the art, in the open configuration, the covering or components thereof are rotated, pivoted, tilted, etc. (used interchangeably herein without the intent to limit) so that view through the covering is possible, while in the closed configuration, the covering or components thereof are rotated relative to each other to prevent, or at least substantially inhibit, view through. Thus, in use, the operating mechanism may also be arranged and configured to pivot the covering or components thereof. That is, with the covering in the extended position, the operating mechanism of the horizontally-extending architectural-structure covering may be used to pivot the covering or components thereof to substantially block view through. By controlling the rotation of the covering or components thereof in the extended position and by moving the covering between the extended and retracted positions, the user can control view through the covering and hence, as applied to coverings or windows, the user is able to vary the amount of natural light permitted to enter, for example, the room via the window by adjusting the angular position of the covering or components thereof.

For a variety of reasons, it would be beneficial to control the amount or extent of rotational movement of the covering or components thereof. It is with respect to these and other considerations that the present improvements may be useful.

SUMMARY

This Summary is provided to introduce in a simplified form, a selection of concepts that are further described below in the Detailed Description. This Summary is not intended to identify key features or essential features of the claimed subject matter, nor is it intended as an aid in determining the scope of the claimed subject matter.

Disclosed herein is an improved tilt-control assembly for use in an architectural-structure covering such as, for example, a horizontally-extending architectural-structure covering, to control the amount of rotation of the covering or components thereof. In use, the tilt-control assembly may be used in connection with an operating mechanism of the architectural-structure covering to control the amount of rotation of the covering or components thereof. In one embodiment, the tilt-control assembly includes a limiter having an external helix or screw thread formed thereon and a ball. In use, the ball is operatively associated with the limiter so that, during use, rotation of the operating mechanism for rotating the covering or components thereof by a user causes the ball to move with respect to the limiter. In use, when the ball contacts the end of the helix or screw thread formed on the limiter, additional rotation of the limiter relative to the ball, and thus additional rotation of the operating mechanism, is thereby prevented.

In one embodiment, the external helix or screw thread formed on the limiter includes variable pitch threads. For example, in one embodiment, the screw thread in the middle portion of the limiter may be different from the screw thread adjacent to the end portions of the limiter. By incorporating variable pitch threads, a shorter limiter than otherwise possible can be utilized, thus saving valuable space within the operating mechanism.

Additionally, and/or alternatively, the limiter and/or screw thread formed on the limiter may include a variable diameter. For example, in one embodiment, the diameter in the middle portion of the screw thread may be different from the diameter adjacent to the end portions.

DETAILED DESCRIPTION

Figure 1:
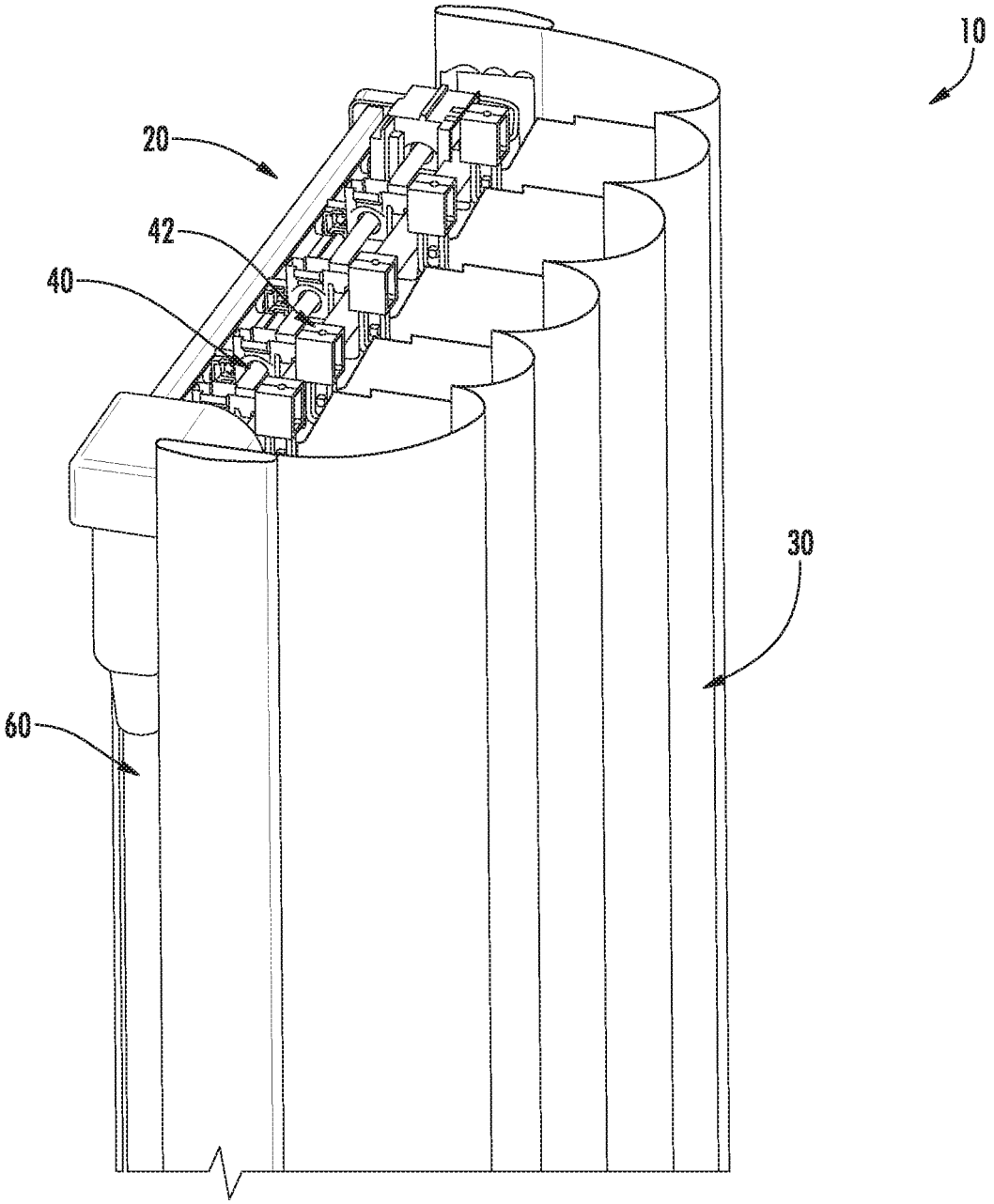
FIG. 1 is a front perspective view illustrating an example embodiment of an architectural-structure covering including a covering shown in an extended position.

Various features, aspects, or the like of a tilt-control assembly for use with an operating mechanism of an architectural-structure covering will now be described more fully hereinafter with reference to the accompanying drawings, in which one or more aspects of the tilt-control assembly will be shown and described. It should be appreciated that the various features, aspects, or the like may be used independently of, or in combination, with each other. It will be appreciated that a tilt-control assembly as disclosed herein may be embodied in many different forms and should not be construed as being limited to the embodiments set forth herein. Rather, these embodiments are provided so that this disclosure will convey certain aspects of the tilt-control assembly to those skilled in the art. In the drawings, like numbers refer to like elements throughout unless otherwise noted.

It should be understood that, as described herein, an "embodiment" (such as illustrated in the accompanying Figures) may refer to an illustrative representation of an environment or article or component in which a disclosed concept or feature may be provided or embodied, or to the representation of a manner in which just the concept or feature may be provided or embodied. However, such illustrated embodiments are to be understood as examples (unless otherwise stated), and other manners of embodying the described concepts or features, such as may be understood by one of ordinary skill in the art upon learning the concepts or features from the present disclosure, are within the scope of the disclosure. In addition, it will be appreciated that while the Figures may show one or more embodiments of concepts or features together in a single embodiment of an environment, article, or component incorporating such concepts or features, such concepts or features are to be understood (unless otherwise specified) as independent of and separate from one another and are shown together for the sake of convenience and without intent to limit to being present or used together. For instance, features illustrated or described as part of one embodiment can be used separately, or with another embodiment to yield a still further embodiment. Thus, it is intended that the present subject matter covers such modifications and variations as come within the scope of the appended claims and their equivalents.

As will be described in greater detail below, the tilt-control assembly of the present disclosure may be used in connection with an operating mechanism of an architectural-structure covering such as, for example, a horizontally-extending architectural-structure covering. Generally speaking, horizontally-extending architectural-structure coverings may be movable between an extended position and a retracted position. In this manner, the covering of the architectural-structure covering may be moved between the extended position, where the covering extends widthwise across a head rail assembly so that the architectural structure (e.g., window) is covered, and the retracted position, where the covering is positioned or stacked adjacent to one or both ends of the head rail assembly so that the architectural structure is substantially exposed. In addition, the covering or components thereof may be tiltable, rotatable, pivotable, etc. (used interchangeably herein without the intent to limit) so that the angle of the covering or the components thereof may be controlled so that the covering or components thereof may be moved between an open configuration, in which the covering or components thereof are orientated so that view through the covering is possible, and a closed configuration, in which the covering or components thereof are orientated to prevent, or at least substantially inhibit, view through (e.g., covering or components thereof are rotatable to block, or at least substantially block, view through).

In one embodiment, the operating mechanism for rotating the angle of the covering or components thereof may include or be operatively associated with or coupled to a tilt-control assembly for controlling the amount of rotation that the covering or components thereof can undergo. That is, in one embodiment, a tilt-control assembly for use with an operating mechanism of an architectural-structure covering is disclosed. The tilt-control assembly comprising a limiter having an external screw thread, the screw thread including a first end, a second end, and a middle portion positioned between the first and second ends; and a ball operatively associated with the external screw thread so that rotation of the limiter moves the ball relative to the limiter; wherein the screw thread includes variable pitch threads.

In another embodiment, a horizontally-extending architectural-structure covering is disclosed. The architectural-structure covering comprising: a head rail assembly including a control system; a covering operatively coupled to the control system, the covering being movable between an extended position and a retracted position, and the covering being pivotable between an open configuration and a closed configuration; an operating mechanism for actuating the control system to move the covering between extended and retracted positions, and for pivoting the covering between the open and closed configurations; and a tilt-control assembly for controlling an amount of pivoting of the covering. The tilt-control assembly including: a limiter having a first end, a second end, and an external screw thread positioned between the first and second ends; and a ball operatively associated with the external screw thread so that rotation of the limiter moves the ball relative to the limiter; wherein the screw thread includes variable pitch threads.

During use, operation (e.g., movement, rotation, etc.) of the operating mechanism for rotating the covering or components thereof by a user causes the ball to move with respect to the limiter. In use, when the ball contacts the end of the screw thread formed on the limiter, additional rotation of the limiter relative to the ball, and thus additional operation (e.g., movement, rotation, etc.) of the operating mechanism, is thereby prevented. As such, in use, with the covering or components thereof in the open configuration, the ball may be located in a first position, approximately positioned in a middle of the external threaded screw thread. Thereafter, operation of the operating mechanism by a user causes the limiter to rotate, which causes the ball to move relative to the externally threaded screw thread to a second position. In the second position, the ball reaches or contacts an optional stop such as, for example, one of the first and second end portions of the screw thread formed on the limiter. Once the ball reaches the end of the screw thread formed on the limiter, further rotation of the limiter is prevented. In this manner, movement of the ball relative to the limiter prevents over-rotation of the operating element and operating mechanism, thus minimizing the potential for damage.

In one embodiment, as previously mentioned, in accordance with a separate and independent aspect of the present disclosure, the external screw thread formed on the limiter includes variable pitch threads. For example, in one embodiment, the limiter includes a first end, a second end, and a middle portion positioned between the first and second ends. The screw thread in the middle portion of the limiter including a different thread pitch than the screw thread adjacent to the ends of the limiter. As such, in one embodiment, the limiter includes a middle thread pitch in the middle portion of the screw thread and an end thread pitch adjacent to the ends of the screw thread, the middle thread pitch being smaller than the end thread pitch. In addition, the first and second ends of the limiter may include the same or different thread pitches relative to each other. For example, the first end of the screw thread may include a first end thread pitch, the second end of the screw thread may include a second end thread pitch, the middle thread pitch being smaller than the first end thread pitch and the second end thread pitch.

Additionally, and/or alternatively, the limiter and/or screw threads formed on the limiter may include a variable diameter. For example, in one embodiment, the diameter of the limiter and/or screw thread in the middle portion of the screw thread may be different than the diameter adjacent to the ends of the screw threads. As such, in one embodiment, the screw thread may include a middle diameter in the middle portion and an end diameter adjacent to the ends, the middle diameter being smaller than the end diameters. In addition, the first and second ends of the limiter may include different diameters relative to each other. For example, the first end of the screw thread may include a first end diameter, the second end of the screw thread may include a second end diameter, the middle diameter being smaller than the first end diameter and the second end diameter.

In addition, and/or alternatively, in one embodiment, the ball may reside in (e.g., positioned within) a groove formed in a surface of the operating mechanism, the groove being substantially aligned with and spaced from the external screw threads formed on the limiter. In use, the surface of the operating mechanism maintains a constant distance from the external screw thread of the limiter. Thus, in the embodiment where the limiter and/or screw threads have a variable diameter, the surface of the groove may include a corresponding contoured surface that substantially corresponds (e.g., matches) to the outer contoured surface of the limiter (e.g., the surface of the groove may include a contoured, curved, or the like surface that substantially corresponds to the outer contoured surface of the external helix or screw thread formed on the limiter).

Additionally, and/or alternatively, the first and second ends of the screw threads may include substantially spherically shaped end portions for receiving the ball therein.

Figure 2:
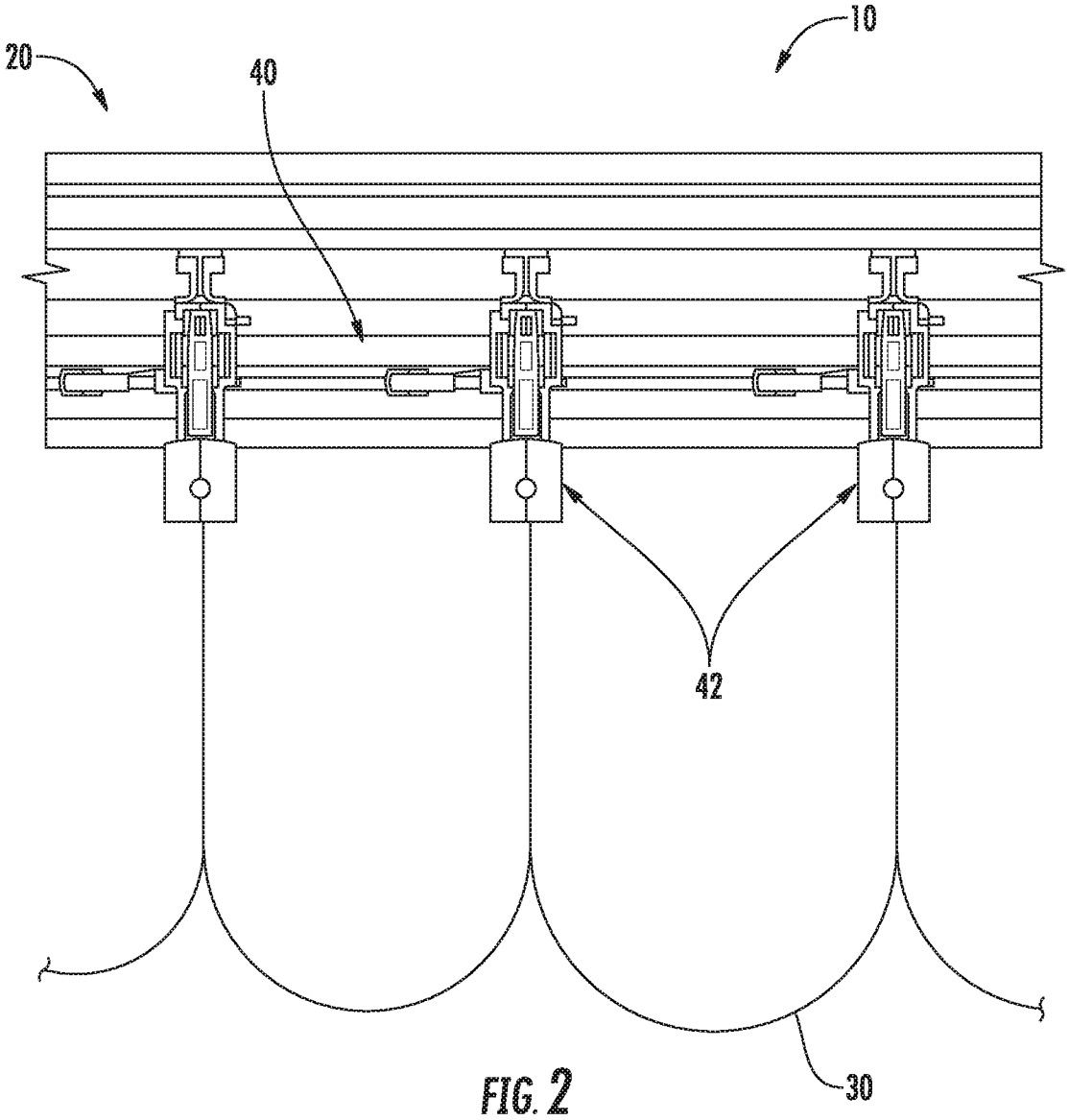
FIG. 2 is a top view of the architectural-structure covering shown in FIG. 1.

Referring to FIGS. 1 to 2, a horizontally-extending architectural-structure covering 10 is shown. Although a particular example of a horizontally-extending architectural-structure covering 10 is shown, many different types and styles exist and could be employed in place of the example architectural-structure covering 10 of FIGS. 1 and 2. In addition, while the tilt-control assembly of the present disclosure will be described and illustrated in connection with controlling the amount of tilt of the covering or components thereof in a horizontally-extending architectural-structure covering, it should be appreciated that the tilt-control assembly may have other applications including, for example, controlling movement of a horizontally-extending architectural-structure covering or components thereof, or a standard architectural-structure covering between the extended and retracted positions. As such, the tilt-control assembly should not be limited solely for use with the horizontally-extending architectural-structure covering shown.

As shown, the architectural-structure covering assembly 10 may include a head rail assembly 20 and a covering 30. In use, the covering 30 or components thereof may be suspended from the head rail assembly 20. In one embodiment, the covering 30 may be manufactured from a continuous sheet of material. Alternatively, the covering 30 may be manufactured from individual strips of material that may be coupled together. In yet another embodiment, the covering 30 may be made of a plurality of individual vanes. The covering 10 may be manufactured from any suitable material now known or hereafter developed including, for example, fabrics, plastics, metal, etc.

The head rail assembly 20 may include, for example, brackets (not shown) for mounting the architectural-structure covering 10 to a wall or other structure. As will be readily appreciated by one of ordinary skill in the art, the covering 30 of the architectural-structure covering 10 may be suspended from the head rail assembly 20 and may be movable along a length of the head rail assembly 20 between an extended position (shown in FIG. 1), to a partially retracted position, and further to a fully retracted position. In addition, the covering 30 or components thereof may be rotatable to control the amount of view through of the covering 30, for example, in the extended position.

As shown, the head rail assembly 20 includes a control system 40 for moving the covering between the extended and retracted positions, and for rotating the covering 30 or components thereof. In use, the covering 30 or components thereof may be coupled to the control system 40 via a coupling mechanism, which for example, may be a tilt rod or pivot shaft coupled to a plurality of carriers, clips, hanger pins, etc. For example, as illustrated, the covering 30 or components thereof may be coupled to the control system 40 (e.g., tilt rod, pivot shaft, etc.) via vertically extending, carriers 42 (FIG. 2) coupled to a top end of the covering 30 or components thereof, although any other now known or hereafter developed coupling mechanism can be used. In use, the carriers 42 are rotatable so that rotation of the control system 40 (e.g., tilt rod, pivot shaft, etc.) rotates the covering 30 or components thereof between the open and closed configurations. In addition, the carriers 42 are slidably positioned relative to the control system 40 within the head rail assembly 20 so that movement of the carriers 42 relative to the control system 40 moves the covering 30 between the extended and retracted positions.

The architectural-structure covering 10 may also include an operating mechanism, which is operatively coupled to one or more operating elements 60 (FIG. 1), for example, a tilt wand, a pull cord, etc. In use, the operating mechanism is operatively coupled to the control system 40 to move the covering 30 between the extended and retracted positions, and to control the angle of the covering 30 or components thereof to control the rotation of the covering 30 or components thereof. In one embodiment, the operating element 60 may include a first operating element for moving the covering 30 between the extended and retracted positions and a second operating element for controlling the angle of the covering 30 or components thereof (e.g., the operating element may be used to rotate the control system 40 (e.g., tilt rod, pivot shaft, etc.) so that the covering 30 or components thereof can be pivoted about longitudinal vertical axes extending through the carriers 42 between an open configuration wherein the covering 30 or components thereof are positioned to permit view through the covering 30 as illustrated in FIG. 2 and a closed configuration wherein the covering 30 or components thereof are rotated to block, or at least substantially block the passage of light and vision through the covering 30.

As will be described herein, the features according to the present disclosure may be used with any suitable architectural-structure covering now known or hereafter developed. As such, the features of the present disclosure that will be described herein should not be limited to the details of the architectural-structure covering unless specifically claimed. Moreover, additional details regarding construction and operation of the architectural-structure covering are omitted for sake of brevity of the present disclosure. Additional information on the structure and operation of an architectural-structure covering and the components thereof, can be found in U.S. Pat. No. 5,603,369 entitled Fabric Window Covering with Vertically Rigidified Vanes; U.S. Pat. No. 4,724,883 entitled Drapery and Vertical Blind System; United States Published Patent Application No. 2017/0241198 entitled Dual Cord Operating System for an Architectural Covering; and United States Published Patent Application No. 2018/0298684 entitled Vertically-Suspended Architectural Structure covering, the entire contents of which are hereby incorporated by reference.

For the sake of convenience and clarity, terms such as "front," "rear," "top," "bottom," "up," "down," "vertical," "horizontal", "inner," and "outer" may be used herein to describe the relative placement and orientation of various components and portions of the architectural-structure covering 10, and are non-limiting. Said terminology will include the words specifically mentioned, derivatives thereof, and words of similar import.

Referring now to FIGS. 3-6, an improved tilt-control assembly used in connection with an architectural-structure covering will now be described. In accordance with one aspect of the present disclosure, the tilt-control assembly may be used in connection with an operating mechanism to control (e.g., limit) the amount of rotation of the covering or components thereof in the extended position. In use, the tilt-control assembly can be used in combination with any suitable operating mechanism including, for example, mechanical operating mechanisms (e.g., wand or corded assemblies, traveling wand assemblies, or the like), electrically operated mechanisms (e.g., remote-controlled assemblies), etc. In addition, the tilt-control assembly can be positioned anywhere along a length of the headrail 20 and/or the control system 40 (e.g., the tilt-control assembly should not be limited to the embodiment shown where the tilt-control assembly is coupled to an end of the headrail assembly and in direct contact with the vertical tilt rod 120.

As previously mentioned, the operating mechanism may include a first operating mechanism operatively associated with a first drive mechanism for moving the covering between the extended and retracted positions. In addition, the operating mechanism may include a second operating mechanism operatively associated with a second drive mechanism for moving (e.g., rotating) the covering 30 or components thereof between open and closed configurations. As will be described herein, the tilt-control assembly is used to control an amount of rotation of the covering 30 or components thereof. As such, for sake of brevity, the operating mechanism for moving (e.g., rotating) the covering 30 or components thereof between open and closed configuration will be described and illustrated herein. As will be appreciated by one of ordinary skill in the art, the architectural-structure covering may also include an operating mechanism for moving the covering between the extended and retracted positions.

Referring to FIGS. 3-6, in accordance with one aspect of the present disclosure, an operating mechanism 100 including a tilt-control assembly 150 is shown. As shown, the operating mechanism 100 includes a housing 102. In use, the housing 102 may be coupled to one end of a head rail assembly such as, for example, head rail assembly 20, although such is not required and the tilt-control assembly may be positioned elsewhere along the length of the head rail assembly. In the illustrated embodiment, the housing 102 may include one or more projections 104 for snap-fitting to an end of the head rail assembly 20 and the housing 102 may be threadably fastened to the end of the head rail assembly 20, although other coupling mechanism are envisioned.

As illustrated, in one embodiment, and as will be readily appreciated by one of ordinary skill in the art, the operating mechanism 100 includes a first or horizontal tilt rod 110, and a second or vertical tilt rod 120. In use, the second or vertical tilt rod 120 is operatively associated or coupled, directly or indirectly, with an operating element 60 (FIG. 1) so that operation (e.g., movement, rotation, etc.) of the operating elements 60 moves (e.g., rotates) the second or vertical tilt rod 120. In addition, the second or vertical tilt rod 120 is operatively associated or coupled, directly or indirectly, with the first or horizontal tilt rod 110, which is operatively associated or coupled, directly or indirectly to, the control system 40 of the head rail assembly 20. In this manner, during use, operation of the operating element 60 moves (e.g., rotates) the second or vertical tilt rod 120, which rotates the first or horizontal tilt rod 110, which causes the carriers 42 of the control system 40 of the head rail assembly 20 to rotate the covering 30 or components thereof. The second or vertical tilt rod 120 may be coupled to the first or horizontal tilt rod 110 by any now known or hereafter developed coupling mechanism. For example, as illustrated, in one embodiment, the vertical and horizontal tilt rods 120, 110 may include a gear assembly 130 for transferring rotation of the vertical tilt rod 120 to the horizontal tilt rod 110. That is, as illustrated, the vertical tilt rod 120 may include first and second ends 122, 124. The first end 122 of the vertical tilt rod 120 may include a gear 132 such as, for example a spur or bevel gear for coupling with a corresponding gear 134 on the horizontal tilt rod 110. In this manner, rotation of the vertical tilt rod 120 rotates the horizontal tilt rod 110, which is then transferred to the control system 40 of the head rail assembly 20 and eventually to the covering 30 or components thereof.

In use, the second end 124 of the vertical tilt rod 120 may be operatively associated or coupled to an operating element such as, for example, operating element 60, which may be in the form of, for example, a wand, a rod, a cord, etc. In use, the operating element provides a convenient touch point for the user to operate (e.g., rotate) the vertical tilt rod 120. For example, in one embodiment, an operating wand may be rotated by a user about its longitudinal axis to rotate the vertical tilt rod 120, which rotates the horizontal tilt rod 110, which controls and/or moves the control system 40 to move (e.g., rotate) the covering 30 or components thereof between open and closed configurations.

Referring to FIGS. 3-6, and as previously mentioned, the operating mechanism 100 includes a tilt-control assembly 150 for controlling the amount of movement of the horizontal tilt rod 110, and hence the amount of rotation of the covering 30 or components thereof (see FIGS. 1 and 2). That is, as shown, in one embodiment, the tilt-control assembly 150 may include a limiter 160. The limiter 160 may be in the form of a cylindrical member having an external threaded helix or screw thread 165 (used interchangeably herein without the intent to limit). The tilt-control assembly 150 also includes a ball 170. As will be described in greater detail, in use, the ball 170 is movable relative to the limiter 160 to control rotation of the horizontal tilt rod 110, and hence the covering 30 or components thereof. That is, as will be described in greater detail, in use, the ball 170 is movably positioned along a length of the screw thread 165 formed on the limiter 160. Thus, in use, rotation of the horizontal tilt rod 110 causes the ball 170 to move along the length of the screw thread 165 until the ball 170 contacts an end of the screw thread 165, at which point further rotation of the horizontal tilt rod 110 is prevented.

Figure 6:
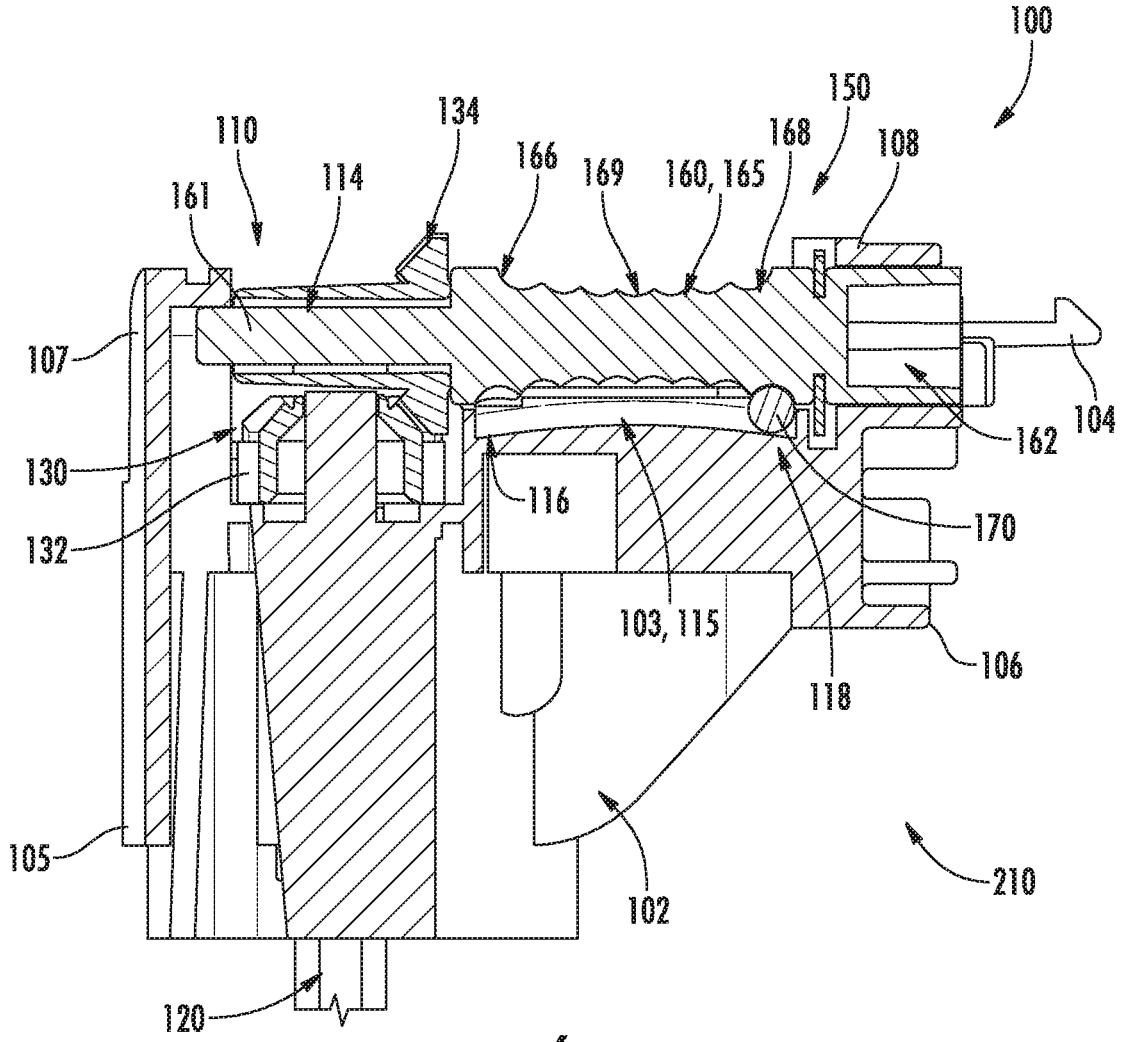
FIG. 6 is a cross-sectional view illustrating the operating mechanism and tilt-control assembly shown in FIG. 3, the cross-sectional view taken along line VI-VI in FIG. 5.

In use, the tilt-control assembly 150 is operatively associated with the horizontal tilt rod 110. The limiter 160 may be operatively associated with the horizontal tilt rod 110 by any suitable mechanism now known or hereafter developed. For example, in one embodiment, as shown in FIG. 6, the horizontal tilt rod 110 including the gear 134 formed thereon may be arranged and configured with an opening 114 for receiving a first portion 161 of the limiter 160 therein. Additionally, the limiter 160 is operatively associated with the control system 40. The limiter 160 may be operatively associated with the control system 40 by any suitable mechanism now known or hereafter developed. For example, in one embodiment, as shown in FIG. 6, the limiter 160 may include a connector or opening 162 positioned at an end of the limiter 160 opposite the first portion 161 for operatively coupling to the control system 40. Alternatively, in another embodiment, the limiter 160 and the horizontal tilt rod 110 may be integrally formed.

Figure 4:
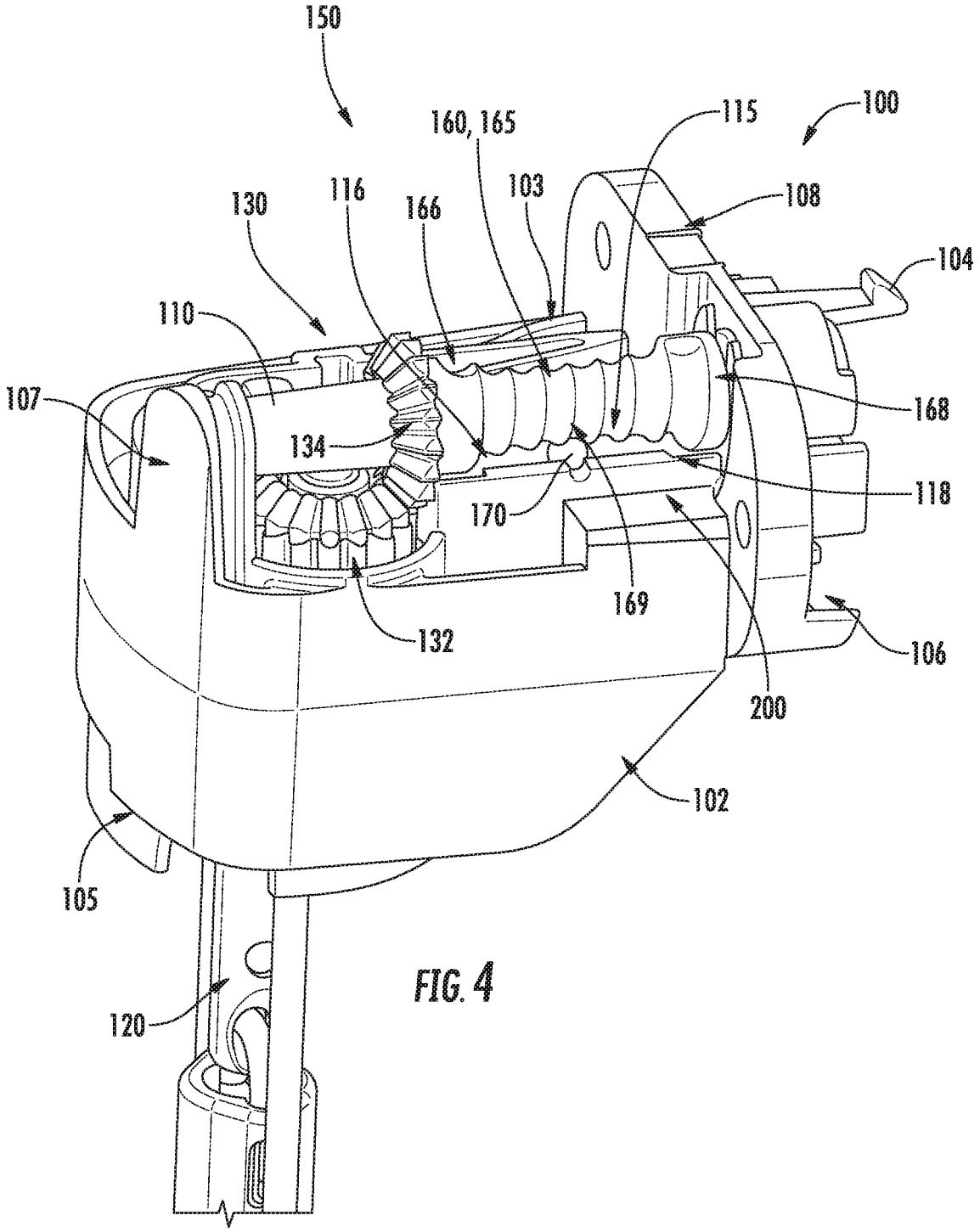
FIG. 4 is a top, detail, partial perspective view illustrating the operating mechanism and tilt-control assembly shown in FIG. 3, the tilt-control assembly illustrated in a first position.
Figure 5:
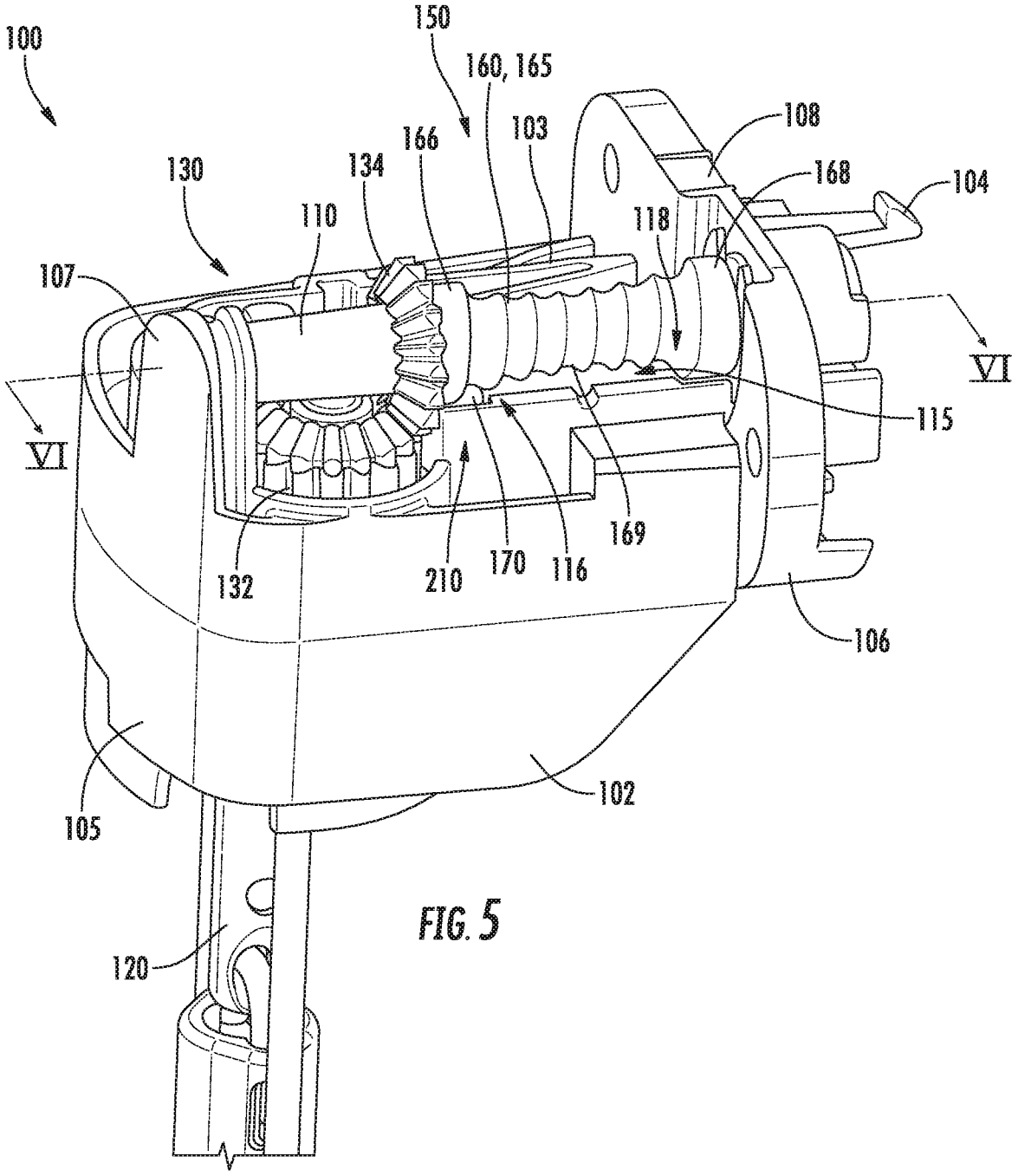
FIG. 5 is a top, detail, partial perspective view illustrating the operating mechanism and tilt-control assembly shown in FIG. 3, the tilt-control assembly illustrated in a second position.

Referring to FIGS. 4-6, in one embodiment, the housing 102 includes a top surface 103, a first end 105, and a second end 106. Additionally, the housing 102 may include first and second flanges 107, 108 for rotatably receiving, coupling, holding, etc. the limiter 160 between the first and second flanges 107, 108. As illustrated, the top surface 103 of the housing 102 includes a groove 115 formed therein. The groove 115 includes a first end 116 and a second end 118. Once assembled, the groove 115 is arranged and configured to be positioned beneath, and axially aligned with, the externally threaded screw thread 165 formed on the limiter 160. Additionally, in use, the groove 115 is arranged and configured to receive the ball 170 therein so that, during use, the ball 170 moves within the groove 115 formed in the top surface 103 of the housing 102 and relative to the externally threaded screw threads 165 so that rotation of the horizontal tilt rod 110, and hence the limiter 160, causes the ball 170 to move between the first and second ends 116, 118 of the groove 115.

Figure 3:
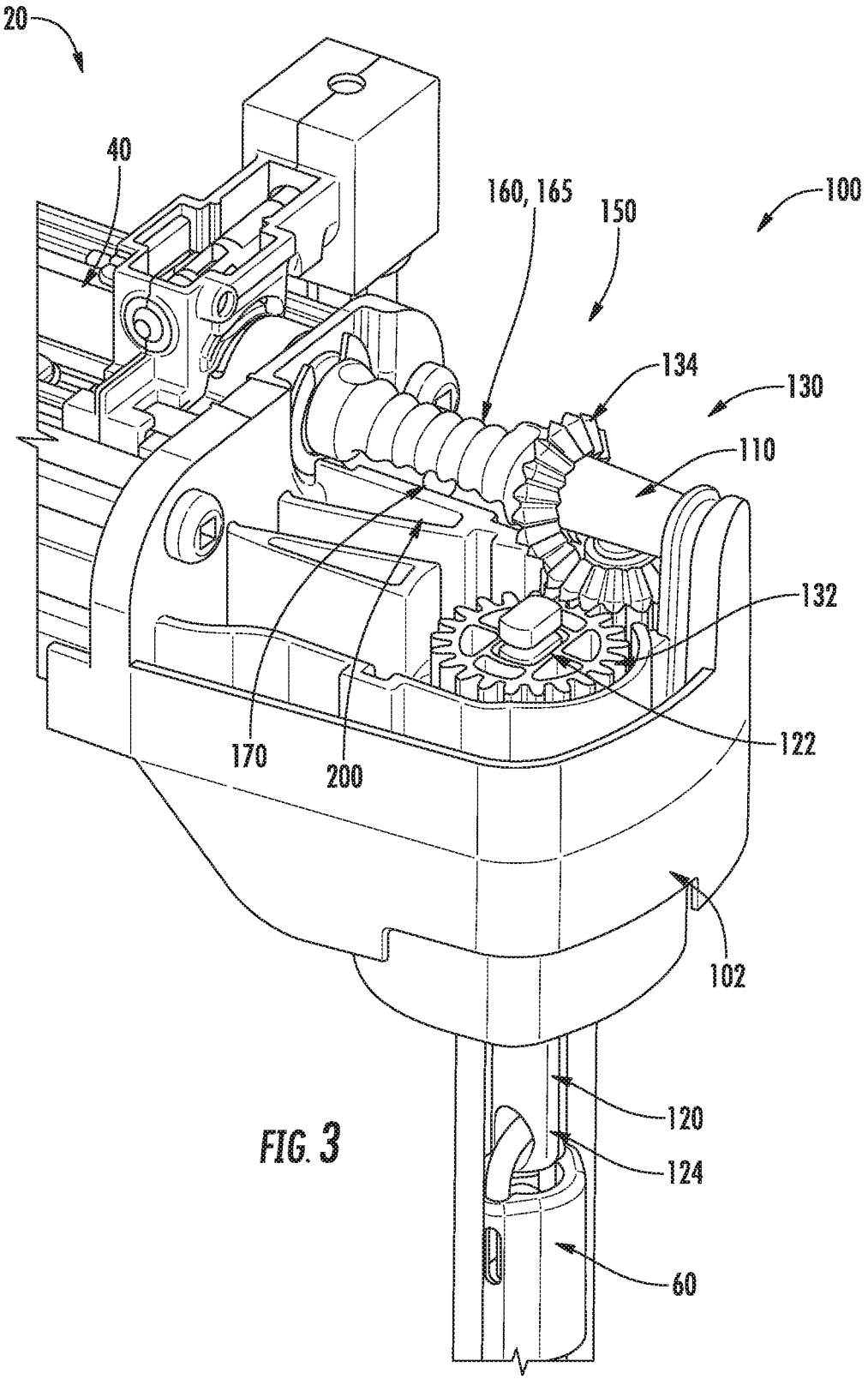
FIG. 3 is a top, detail, partial perspective view of an example embodiment of an operating mechanism coupled to a head rail assembly of the architectural-structure covering shown in FIG. 1, the operating mechanism including a tilt-control assembly.

In use, as previously described, rotation of the horizontal tilt rod 110 causes the ball 170 to move along the length of the externally threaded screw thread 165 formed on the limiter 160 until the ball 170 contacts an optional stop and/or an end of the screw thread 165, at which point further rotation of the limiter 160 and the horizontal tilt rod 110 is prevented. For example, as illustrated in FIGS. 3 and 4, with the covering 30 or components thereof (FIGS. 1 and 2) in an open configuration, the ball 170 may be located in a first position 200, approximately positioned in a middle of the external threaded screw thread 165. Thereafter, operation (e.g., movement, rotation, etc.) of the operating element 60 by a user causes the vertical tilt rod 120 to rotate, which rotates the horizontal tilt rod 110, and hence the limiter 160, which causes the ball 170 to move relative to the externally threaded screw thread 165 to a second position 210, which corresponds to the ball 170 reaching or contacting one of the end portions of the screw thread 165 formed on the limiter 160 as shown in FIGS. 5 and 6. Once the ball 170 reaches the end of the screw thread 165 formed on the limiter 160, further rotation of the limiter 160, and hence the horizontal tilt rod 110, is prevented. In this manner, movement of the ball 170 relative to the limiter 160 prevents over-rotation of the operating element 60 and operating mechanism 100, thus minimizing the potential for damage.

For example, as illustrated in FIGS. 3 and 4, with the ball 170 approximately positioned in the middle of the screw thread 165 formed on the limiter 160 (referred to herein as the first position 200), the covering 30 or components thereof (see FIGS. 1 and 2) may be positioned in an open configuration so that light is permitted to pass through the covering 30 or components thereof. Thereafter, operation (e.g., rotation) of the operating element 60 by a user causes the horizontal tilt rod 110, and hence the limiter 160, to rotate, which causes the ball 170 to move relative to the screw thread 165 formed on the limiter 160 until the ball 170 reaches or contacts an end portion of the limiter 160 and/or screw thread 165 as shown in FIGS. 5 and 6. As such, in use, the ball 170 is arranged and configured to move relative to the limiter 160 from the first position 200, where the ball 170 is positioned approximately in a middle portion 169 of the screw thread 165 formed on the limiter 160 (as shown in FIGS. 3 and 4) to the second position 210, where the ball 170 is positioned at either end 166, 168 of the screw thread 165 formed on the limiter 160 (as shown in FIGS. 5 and 6). Once the ball 170 reaches either end of the screw thread 165 formed on the limiter 160, further rotation of the limiter 160, and hence the horizontal tilt rod 110, is prevented. In use, the externally threaded screw thread 165 formed on the limiter 160 is arranged and configured so that when the ball 170 reaches the end of the limiter 160 and/or screw thread 165 (referred to herein as a second position 210), the covering 30 or components thereof may be positioned in the closed configuration so that light is prevented, or at least inhibited, from passing through the covering 30. By controlling the amount of rotation of the limiter 160, over-rotation of the covering 30 or components thereof are also prevented from over-rotation.

Referring again to FIGS. 3-6, in accordance with one aspect of the tilt-control assembly 150, the limiter 160 may include a variable pitch screw thread 165. For example, in one embodiment, the limiter 160 may include a screw thread 165 that varies in pitch along a length of the limiter 160 such as, for example, from groove-to-groove. Alternatively, as shown in the illustrated embodiment, the externally threaded screw thread 165 formed on the limiter 160 may include the first end 166, the second end 168, and the middle portion 169 positioned therebetween. In use, the externally threaded screw thread 165 formed on the limiter 160 has a variable pitch thread. For example, as illustrated, the thread pitch in the middle portion 169 of the limiter 160 may be different than the thread pitch of the externally threaded screw thread 165 formed on the limiter 160 adjacent to the first and second ends 166, 168 thereof. In one embodiment, the thread pitch in the middle portion 169 of the limiter 160 may be smaller than the thread pitch of the externally threaded screw thread 165 formed on the limiter 160 adjacent to the first and second ends 166, 168 thereof. That is, the screw thread 165 formed on the limiter 160 may include a middle thread pitch in the middle portion 169 and an end thread pitch adjacent to the ends 166, 168. As shown, in one embodiment, the middle thread pitch is smaller than the end thread pitch. In addition, the first and second ends 166, 168 may have the same or different thread pitches relative to each other. For example, the first end 166 may have a first end thread pitch and the second end 168 may have a second end thread pitch, the middle thread pitch being smaller than the first end thread pitch and the second end thread pitch. By providing a smaller thread pitch in the middle portion 169 of the limiter 160, an overall length of the limiter 160 can be decreased. That is, by decreasing the thread pitch (e.g., placing the threads closer together) in the middle portion 169 of the limiter 160, longitudinal movement/translation of the ball 170 relative to the limiter 160 is decreased per rotation of the limiter 160 (e.g., as the thread pitch increases (revolutions/inch), the travel along the length of the limiter 160 decreases—an increased number of revolutions is required to achieve a given distance along the length of the limiter 160), thus the overall length of the limiter 160 can be shorter (e.g., by decreasing the thread pitch, a shorter overall length of the limiter 160 can be achieved thereby saving valuable space within the head rail of the architectural-structure covering). However, towards the ends 166, 168 of the limiter 160, where engagement between the ball 170 and the limiter 160 is more important to ensure that the ball 170 prevents additional rotation of the limiter 160 when the ball 170 contacts one of the ends 166, 168 of the limiter 160, an increased thread pitch (e.g., larger distance between the threads) provides increased surface area between the ball 170 and the limiter 160 to provide increased stopping power (e.g., by providing an increased surface area between the threads at the ends of the limiter 160, a larger amount of the ball 170 can be received against a base of the limiter 160). In addition, the increased surface area better enables the ball 170 to more precisely move against the top surface of the groove 115 formed in the housing 102. For example, in one embodiment, the thread pitch may be 0.13"/revolution at one of the ends 166 of the limiter 160. Thereafter, the thread pitch may decrease to 0.095"/revolution at for example, 25% of the total threaded length. Thereafter, the thread pitch may remain at 0.095"/revolution from about 25% to about 75% of the total threaded length. Finally, the thread pitch, from 75% to 100% of the length of the thread, may begin to increase so that by 100% or at the other end 168 of the limiter 160, the thread pitch is 0.13"/revolution, although these dimensions are exemplary and other dimensions are envisioned. That is, in use, the configuration, dimensions, etc. will be selected based on the particular environment in which the limiter is being used. As such, one of ordinary skill in the art can select the specific dimensions, etc. based on the particular environment in which the limiter is being used. As will be appreciated by one of ordinary skill in the art, the ball 170 need not be sized and configured to fit exactly within the space between adjacent threads formed on the limiter 160 (e.g., the size of the ball 170 need not exactly correspond to the spacing of the threads).

Referring to FIG. 6, in accordance with another aspect of the tilt-control assembly 150, the externally threaded screw thread 165 formed on the limiter 160 may include a variable diameter. For example, the limiter 160 and/or the externally threaded screw thread 165 formed on the limiter 160 may include a different diameter in the middle portion 169 than adjacent to the first and second ends 166, 168. As illustrated, the limiter 160 and/or the externally threaded screw thread 165 formed on the limiter 160 may include a larger diameter adjacent to the first and second ends 166, 168, and a smaller diameter in the middle portion 169. That is, in one embodiment, the limiter 160 and/or the screw thread 165 formed on the limiter 160 includes a middle diameter in the middle portion 169 and an end diameter adjacent to the first and second ends 166, 168. As shown, in one embodiment, the middle diameter is smaller than the end diameter. In this manner, the screw thread 165 formed on the limiter 160 may have a concave profile when viewed along a longitudinal axis of the limiter 160. In addition, the first and second ends 166, 168 may have the same or different diameters relative to each other. For example, the first end 166 may have a first end diameter and the second end 168 may have a second end diameter, the middle diameter being smaller than the first end diameter and the second end diameter. Once again, the configuration, dimensions, etc. will be selected based on the particular environment in which the limiter is being used. As such, one of ordinary skill in the art can select the specific dimensions, etc. based on the particular environment in which the limiter is being used.

In addition, as shown, the groove 115 formed in the top surface 103 of the housing 102 may include a contoured, curved, or the like surface that substantially corresponds to (e.g., matches) the contoured, curved, or the like profile of the limiter 160 and/or the externally threaded screw thread 165 formed on the limiter 160. By providing corresponding contoured surfaces, the ball 170 remains in contact with the externally threaded screw thread 165 formed on the limiter 160 so that rotation of the limiter 160 moves the ball 170 relative thereto. Alternatively, the groove 115 and the limiter 160 and/or the externally threaded screw thread 165 formed on the limiter 160 may have different profiles including, for example, parallel surfaces.

Referring to FIGS. 3-6, in accordance with another aspect of the tilt-control assembly 150, the first and second end 166, 168 of the externally threaded screw thread 165 formed on the limiter 160 may include substantially spherically shaped or concave end portions. By providing spherically shaped or concave end portions or pockets, in use, when the ball 170 reaches either of the first or second ends 166, 168 of the externally threaded screw thread 165 formed on the limiter 160, the ball 170 is forced downwards against the surface of the groove 115 to facilitate prevention of additional rotation.

Figure 7:
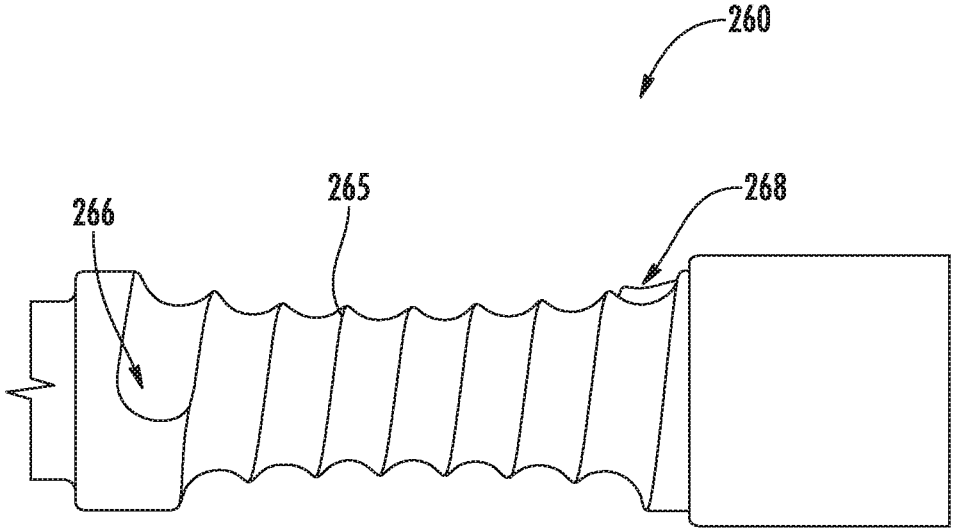
FIG. 7 is a side view of an alternate example of an embodiment of a limiter that may be used in the tilt-control assembly shown in FIGS. 3-6.

Referring to FIG. 7, in accordance with another aspect of the tilt-control assembly 150, an alternate example of an embodiment of a limiter 260 is shown. In use, the limiter 260 is substantially similar to the limiter 160 as previously described in connection with FIGS. 3-6, thus for the sake of brevity, only the differences will be described herein. Referring to FIG. 7, the limiter 260 includes an externally threaded screw thread 265 having first and second ends 266, 268. As previously mentioned, the first and second ends 266, 268 of the externally threaded screw threads 265 may include substantially spherically shaped or concave end portions. In contrast to the limiter 160 shown and described in connection with FIGS. 3-6, the end portions of the first and second ends 266, 268 of the externally threaded screw 265 may be offset relative to each other (e.g., offset circumferentially). That is, as illustrated, the end portion of the first end 266 may be offset relative to the end portion of the second end 268. For example, in one embodiment, it is envisioned that the end portions of the first and second ends 266, 268 may be offset by 95 degrees relative to each other, although this dimension is only one example, and the end portions may be offset by more or less amounts relative to each other. By providing an offset, additional rotational can be provided in one direction versus the other to ensure, for example, full closure of the covering. In one embodiment, the helix or screw thread of the limiter 260 may be asymmetric so that the overall length of the limiter remains unchanged thereby maintaining the size and dimensions of the corresponding groove 115 in which the ball rides.

The limiter may be manufactured from any suitable material now known or hereafter developed. In use, the material selected will depend on the mechanism in which the limiter is used and the forces that will be applied. For example, in one embodiment, the limiter may be manufactured from a zinc alloy while the housing may be manufactured from a plastic such as, for example, a polycarbonate, a glass filled polycarbonate, a nylon, etc.

The foregoing description has broad application. Accordingly, the discussion of any embodiment is meant only to be explanatory and is not intended to suggest that the scope of the disclosure, including the claims, is limited to these example embodiments. In other words, while illustrative embodiments of the disclosure have been described in detail herein, it is to be understood that the inventive concepts may be otherwise variously embodied and employed, and that the appended claims are intended to be construed to include such variations, except as limited by the prior art.

The term "a" or "an" entity, as used herein, refers to one or more of that entity. As such, the terms "a" (or "an"), "one or more" and "at least one" can be used interchangeably herein. The use of "including," "comprising," or "having" and variations thereof herein is meant to encompass the items listed thereafter and equivalents thereof as well as additional items. Accordingly, the terms "including," "comprising," or "having" and variations thereof are open-ended expressions and can be used interchangeably herein. The phrases "at least one", "one or more", and "and/or", as used herein, are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

All directional references (e.g., proximal, distal, upper, lower, upward, downward, left, right, lateral, longitudinal, front, back, top, bottom, above, below, vertical, horizontal, radial, axial, clockwise, and counterclockwise) are only used for identification purposes to aid the reader's understanding of the present disclosure, and do not create limitations, particularly as to the position, orientation, or use of this disclosure. Connection references (e.g., attached, coupled, connected, and joined) are to be construed broadly and may include intermediate members between a collection of elements and relative movement between elements unless otherwise indicated. As such, connection references do not necessarily infer that two elements are directly connected and in fixed relation to each other. Identification references (e.g., primary, secondary, first, second, third, fourth, etc.) are not intended to connote importance or priority but are used to distinguish one feature from another. The drawings are for purposes of illustration only and the dimensions, positions, order and relative sizes reflected in the drawings attached hereto may vary.

The invention claimed is:

1. A tilt-control assembly for use with an operating mechanism of an architectural-structure covering, the tilt-control assembly comprising:

a limiter having an external screw thread, said screw thread extending from a first end to a second end, the screw thread including a middle portion positioned between said first and second ends; and a ball operatively associated with said external screw thread so that rotation of said limiter moves said ball relative to said limiter;

wherein said screw thread includes variable pitch threads; and wherein said screw thread includes a variable minor diameter such that said screw thread has a first minor diameter in said middle portion and a second minor diameter adjacent to said first and second ends, said second minor diameter being larger than said first minor diameter.

2. The tilt-control assembly of claim 1, wherein, when said ball contacts either of said first or second ends of said screw thread, additional rotation of said limiter is inhibited.

3. The tilt-control assembly of claim 1, wherein said screw thread includes a middle thread pitch in said middle portion of said screw thread and an end thread pitch adjacent to said first end and said second end of said screw thread, said middle thread pitch being smaller than said end thread pitch.

4. The tilt-control assembly of claim 1, wherein said ball is positioned within a groove formed in the operating mechanism, said groove includes a contoured surface that substantially corresponds to said variable minor diameter.

5. The tilt-control assembly of claim 1, wherein said first end and said second end of said screw thread include substantially spherically shaped end portions for receiving said ball therein.

6. The tilt-control assembly of claim 1, wherein said ball is positioned in a groove formed in a surface of the operating mechanism, said groove being substantially aligned with and spaced from said external screw thread formed on said limiter.

7. The tilt-control assembly of claim 6, wherein said limiter includes a contoured outer surface and said groove includes a contoured surface, said contoured surface of said groove substantially corresponding to said contoured outer surface of said limiter.

8. The tilt-control assembly of claim 1, wherein the operating mechanism includes:

a first tilt rod operatively coupled to a control system; and a second tilt rod operatively coupled to said first tilt rod; wherein:

rotation of said second tilt rod rotates said first tilt rod, which moves the control system to rotate the covering between open and closed configurations; and said first tilt rod is coupled to said limiter so that rotation of said first tilt rod rotates said limiter.

9. The tilt-control assembly of claim 8, wherein the operating mechanism includes a housing having a top surface, said groove being formed in said top surface of the housing, said groove being substantially aligned with and spaced from said external screw thread formed on said limiter.

10. The tilt-control assembly of claim 9, wherein said housing of the operating mechanism further includes first and second flanges for rotatably mounting said limiter therebetween.

11. A horizontally-extending architectural-structure covering comprising:

a head rail assembly including a control system;

a covering operatively coupled to said control system, said covering being movable between an extended position and a retracted position, and said covering being pivotable between an open configuration and a closed configuration;

an operating mechanism for actuating said control system to move said covering between said extended position and said retracted position, and for pivoting said covering between said open and closed configurations; and a tilt-control assembly for controlling an amount of pivoting of said covering, said tilt-control assembly including:

a limiter having an external screw thread, said screw thread extending from a first end to a second end, the screw thread including a middle portion positioned between said first and second ends; and a ball operatively associated with said external screw thread so that rotation of said limiter moves said ball relative to said limiter;

wherein said screw thread includes variable pitch threads; and wherein said screw thread includes a variable minor diameter such that said screw thread has a first minor diameter in said middle portion and a second minor diameter adjacent to said first and second ends, said second minor diameter being larger than said first minor diameter.

12. The horizontally-extending architectural-structure covering of claim 11, wherein, when said ball contacts either of said first end or said second end of said screw thread, further rotation of said limiter is inhibited.

13. The horizontally-extending architectural-structure covering of claim 11, wherein said screw thread includes a middle thread pitch in said middle portion of said screw thread and an end thread pitch adjacent to said first end and said second end of said screw thread, said middle thread pitch being smaller than said end thread pitch.

14. The horizontally-extending architectural-structure covering of claim 11, wherein:

said operating mechanism includes a housing having a groove, said groove being substantially aligned with and spaced from said external screw thread formed on said limiter; and said ball is positioned within said groove, said groove includes a contoured surface that substantially corresponds to said variable minor diameter.

15. The horizontally-extending architectural-structure covering of claim 11, wherein said first end and said second end of said screw thread include substantially spherically shaped end portions for receiving said ball therein.

16. The horizontally-extending architectural-structure covering of claim 11, wherein said operating mechanism includes a housing having a groove, said groove being substantially aligned with and spaced from said external screw thread formed on said limiter, and said ball being positioned in said groove.

17. The horizontally-extending architectural-structure covering of claim 16, wherein said limiter includes a contoured outer surface and said groove includes a contoured surface, said contoured surface of said groove substantially corresponding to said contoured outer surface of said limiter.

18. The horizontally-extending architectural-structure covering of claim 16, wherein said housing of said operating mechanism further includes first and second flanges for rotatably mounting said limiter therebetween.

19. The horizontally-extending architectural-structure covering of claim 11, wherein said operating mechanism includes:

a first tilt rod operatively coupled to said control system; and a second tilt rod operatively coupled to said first tilt rod; wherein:

rotation of said second tilt rod rotates said first tilt rod, which moves said control system to rotate said covering between said open and closed configurations; and said first tilt rod is coupled to said limiter so that rotation of said first tilt rod rotates said limiter.

* * * * *